US010099237B2

(12) United States Patent
Davidson et al.

(10) Patent No.: US 10,099,237 B2
(45) Date of Patent: Oct. 16, 2018

(54) LOCALIZED CAN END REPAIR SPRAY

(71) Applicant: Stolle Machinery Company, LLC, Centennial, CO (US)

(72) Inventors: Jason Andrew Davidson, Sidney, OH (US); Dennis Cornelius Stammen, Brookville, OH (US); Andrew Thomas Hogenkamp, Dayton, OH (US); Jeremy D. Love, Piqua, OH (US); Steven Wayne Holt, Sidney, OH (US); Michael Andrew Thomas, Jamestown, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 0 days.

(21) Appl. No.: 15/610,801

(22) Filed: Jun. 1, 2017

(65) Prior Publication Data

US 2017/0348719 A1 Dec. 7, 2017

Related U.S. Application Data

(60) Provisional application No. 62/344,448, filed on Jun. 2, 2016.

(51) Int. Cl.

| | |
|---|---|
| ***B05B 12/12*** | (2006.01) |
| ***B05B 13/02*** | (2006.01) |
| ***B05B 13/04*** | (2006.01) |

(52) U.S. Cl.

CPC ..... *B05B 12/12* (2013.01); *B05B 12/122* (2013.01); *B05B 13/0221* (2013.01); *B05B 13/0405* (2013.01); *B05B 13/0421* (2013.01); *B05B 13/0447* (2013.01)

(58) Field of Classification Search

None

See application file for complete search history.

(56) References Cited

U.S. PATENT DOCUMENTS

| | | | |
|---|---|---|---|
| 4,465,204 | A | 8/1984 | Kaminsky et al. |
| 4,530,631 | A | 7/1985 | Kaminsky et al. |
| 5,969,605 | A | 10/1999 | McIntyre et al. |
| 8,584,615 | B2 | 11/2013 | Stammen |

(Continued)

OTHER PUBLICATIONS

Stolle Machinery Company, LLC, PCT/US2017/35394 Search Report, dated Aug. 22, 2017, 12 pages.

*Primary Examiner* — Jethro M. Pence

(74) *Attorney, Agent, or Firm* — Eckert Seamans Cherin & Mellott, LLC; David C. Jenkins

(57) ABSTRACT

A repair machine is provided. The repair machine is structured to apply a repair fluid to a plurality of can ends. The repair machine includes a can end down stacker assembly, a can end conveyor assembly, and a spray assembly. The can end down stacker assembly is structured to move individual can ends from a stack to a conveyor assembly. The can end conveyor assembly is structured to transport the can ends over a path, the can end conveyor assembly including a number of reference locations. The can end conveyor assembly is disposed adjacent to the can end down stacker assembly and receives can ends therefrom. The spray assembly is disposed adjacent to the can end conveyor assembly downstream of the can end down stacker assembly. The spray assembly includes a locator assembly, a spray gun assembly, a motion assembly, and a control assembly.

13 Claims, 9 Drawing Sheets

(56) References Cited

U.S. PATENT DOCUMENTS

| | | | | |
|---|---|---|---|---|
| 2003/0179920 | A1 | 9/2003 | Hooker et al. | |
| 2007/0218196 | A1* | 9/2007 | McEldowney ..... | B05C 5/0216 427/230 |
| 2012/0298772 | A1 | 11/2012 | Stammen | |

* cited by examiner

LOCALIZED CAN END REPAIR SPRAY

CROSS REFERENCE TO RELATED APPLICATION

This application is a continuation application of and claims priority to U.S. Provisional Patent Application Ser. No. 62/344,448, filed Jun. 2, 2016 entitled, LOCALIZED CAN END REPAIR SPRAY.

BACKGROUND OF THE INVENTION

Field of the Invention

The disclosed concept relates generally to machinery and, more particularly, to machines used to apply and/or repair coatings on can ends in the food and beverage packaging industries. The disclosed concept further relates to spray assemblies and spray heads structured to apply a repair coating in a localized location on the can end.

Background Information

A can for food typically includes a can body having a can end fixed thereto. The can ends are "easy opening" in that a can opener or other device is not needed to access the food. The can ends are characterized by having a pull tab attached to the can end, which is used to fracture a tear panel on the can end defined by a score line on the can end. For example, the pull tab may be lifted to depress the tear panel in order to provide an opening in the can end for dispensing the contents of the container.

Other food products are sold in can bodies provided with full open easy open can ends that are characterized by having a pull tab attached to the can end, which is used to fracture a score line that circumscribes the circumference of the end panel to define an opening panel. For example, the pull tab may be lifted to fracture the score line. After the score line is fractured, the pull tab may be pulled upward from the container to sever the remainder of the score line in order to remove the entire opening panel for dispensing the contents of the container.

In the manufacture of an easy open can end, a pre-converted can end, commonly referred to as a shell, is conveyed to a conversion press. In the typical operation of a conversion press, the shell is introduced between upper and lower tool members, which are in an open, spaced apart position. A press ram moves the upper tool member to a closed position by advancing the upper tool member toward the lower tool member in order to perform any of a variety of tooling operations such as rivet forming, paneling, scoring, embossing, and final staking. After performing a tooling operation, the press ram retracts until the upper tool member and lower tool member are once again in the open, spaced apart position. The partially converted shell is then transported to the next successive tooling operation until an easy open can end is completely formed and discharged from the press. As one shell leaves a given tooling operation, another shell is introduced to the vacated operation, thus continuously repeating the entire easy open can end manufacturing process. Examples of easy open can ends can be found, for example, in U.S. Pat. Nos. 4,465,204 and 4,530,631. Conversion presses can operate at speeds that manufacture in excess of 500 can ends per minute per lane, with some presses having four lanes of tooling thereby manufacturing up to 2,000 converted can ends, or more per minute.

Steel sheet stock used in the manufacture of can ends has a coating that protects the metal by inhibiting oxidation, corrosion or rust from forming on the surface of the metal. During the conversion process, damage to the protective coating typically occurs while forming the rivet to which the pull tab is coupled. As noted above, in the conversion of a shell into a can end with openable features thereon, tooling is employed to form the rivet and to stake (couple) the tab to the rivet. These forming operations may damage the coating and allow rust to form. Any oxidation, corrosion or rust on the surface of the can end that could result from such damage to the protective coating represents an unattractive product appearance to the consumer and is generally unacceptable to can makers. Accordingly, as a precautionary measure to prevent oxidation, corrosion or rust from appearing on the can end, many can makers apply a fluid, repair agent, lacquer or paint to coat the rivet and scored area of the can end by spraying the can end. This process is generally referred to as post repair.

For example, a can may have a generally circular opening, i.e. a generally circular scoreline, wherein the scoreline is located at a selected first radius about the center of the can end. For such a can end, a repair assembly includes a number of spray guns that rotate about a central axis of rotation. The axis of rotation is disposed over the center of the can end and the spray guns are offset from the axis of rotation a distance generally equal to the radius of the scoreline. The spray guns are structured to apply a coating of fluid, repair agent, lacquer or paint, and similar repair materials, (hereinafter "repair fluid") in a direction generally parallel to the axis of rotation. Thus, to repair the scoreline, the spray guns rotate about the axis of rotation while applying the repair fluid.

There are a number of devices and procedures for applying the coating to the rivet area; each of which has disadvantages. For example, when the can ends emerge from the conversion press, the can ends are in the same orientation. As such, a spray assembly or a dauber assembly may be structured to apply the coating at the known location of the rivet. The disadvantage to this system is the requirement of having the repair occur as part of, or immediately after, the forming process. Generally, rivet repair would be more conveniently performed at the same time as scoreline repair. That is, the conversion press and scoreline repair device are not typically located adjacent each other; thus, when two repair devices are used there must be multiple fluid storage assemblies, multiple pumps, etc. Further, when a spray machine is disposed adjacent a conversion press, the spray process may contaminate the conversion press and create other problems, e.g., the can ends may stick to the conversion press conveyor assembly.

Once the can ends are removed from the conversion press and are prepared for further processing, the can ends typically are stacked in a down stacker assembly, i.e. a device that drops a can end onto a conveyor at regular intervals. When stacked, the can ends are not in the same orientation. That is, if the can ends were in the same orientation, the rivets and tabs would be disposed above/below each other. In this configuration, the stack would become lopsided as the rivets/tabs have a greater height compared to the other portions of the can end. Thus, when the can ends emerge from the down stacker, the rivets/tabs are not disposed in the same orientation and, are often disposed at a random orientation. For can ends in a random orientation, the repair fluid must be either applied to a selected location, or, applied to a large area sufficient to encompass the rivets and tabs.

That is, one process of repairing rivets on can ends uses a device similar to the device described above for repairing scorelines. Such a device applies the repair fluid in a circle wherein the offset of the spray guns relative to the axis of rotation is approximately the same as the distance between the center of the can end and the rivet. In this configuration, the repair fluid is applied at machine speeds, i.e. about 500 can ends per minute, but the spray guns apply repair fluid to the rivets as well as the other portions of the can end at the same radius. That is, repair is fast, but the repair fluid is wasted. Alternatively, workers may manually daub repair fluid on the rivets. That is, the can ends are presented to workers who manually apply the repair fluid to the rivets. This procedure is slow and expensive, but repair fluid is generally not wasted.

Accordingly, there is room for improvement in post repair machines and spray assemblies.

SUMMARY OF THE INVENTION

These needs, and others, are met by at least one embodiment of the disclosed and claimed concept. A repair machine is provided. The repair machine is structured to apply a repair fluid to a plurality of can ends. Each can end includes a body and a first deformation. The "first deformation," as used herein, includes a rivet, tab, mustache score, cordial score, locating beads, lettering and/or other structures formed on a can end as known in the art. The can end body has an upper side and a perimeter. The first deformation is disposed on the can end upper side and adjacent the can end body perimeter. The repair machine includes a can end down stacker assembly, a can end conveyor assembly, and a spray assembly. The can end down stacker assembly is structured to move individual can ends from a stack to a conveyor assembly. The can end conveyor assembly is structured to transport the can ends over a path, the can end conveyor assembly including a number of reference locations. The can end conveyor assembly is disposed adjacent to the can end down stacker assembly and receives can ends therefrom. The spray assembly is disposed adjacent to the can end conveyor assembly downstream of the can end down stacker assembly. The spray assembly includes a locator assembly, a spray gun assembly, a motion assembly, and a control assembly.

The locator assembly is structured to determine the location of the first deformation relative to a can end conveyor assembly reference location and to provide a location signal. The spray gun assembly includes a number of gun assemblies and a motion assembly. Each gun assembly is structured to apply a repair fluid to a can end. The motion assembly is structured to receive an orientation signal and, in response to the orientation signal, to position one spray gun in an application orientation relative to the first deformation. The control assembly is structured to receive a location signal, to convert the location signal to orientation data, and to provide an orientation signal. The control assembly is in electronic communication with the locator assembly and the motion assembly.

Thus, generally, the locator assembly detects the location or orientation of the first deformation relative to the conveyor assembly reference location. The locator assembly provides data to the control assembly representing the location or orientation of the first deformation relative to the conveyor assembly reference location. The control assembly adjusts the location of the spray guns via the motion assembly. Once a spray gun is in an application orientation, such as but not limited directly above a rivet, the spray gun is actuated and a repair fluid is applied to the rivet.

In this configuration, the repair fluid is applied at machine speeds but repair fluid is not wasted. That is, in this configuration, the spray assembly, and more broadly the repair machine, described below, solves the stated problems.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
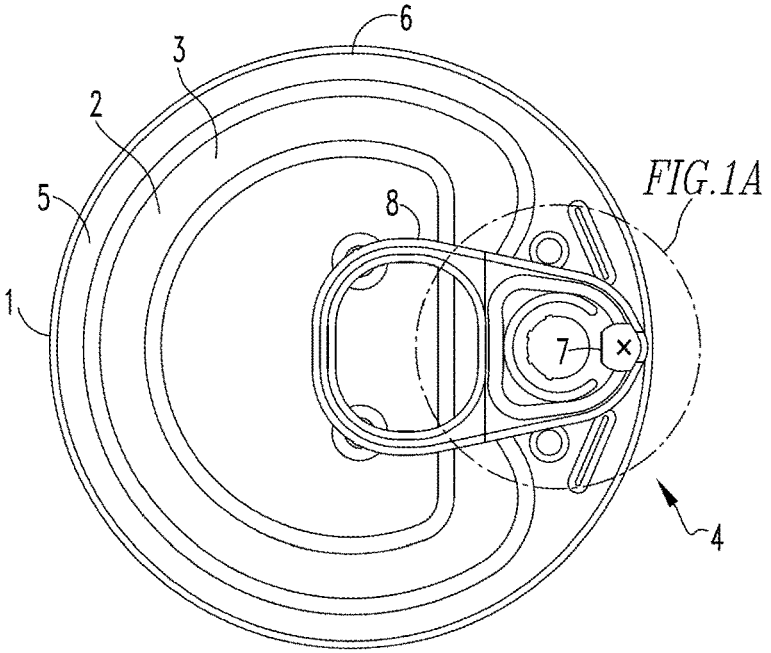
FIG. 1 is an isometric view of a can.
Figure 1A:
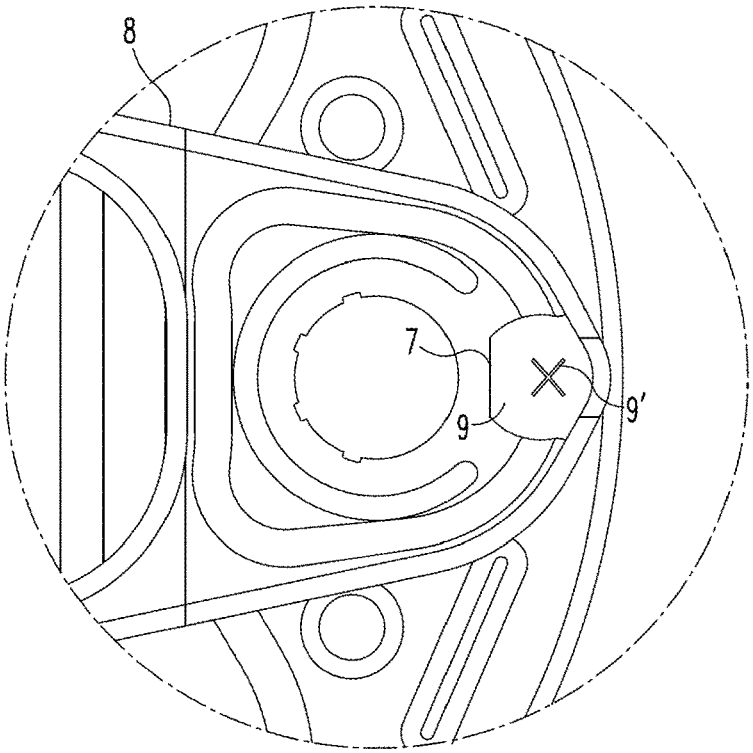
FIG. 1A is a detail view of the can end deformation.
Figure 2:
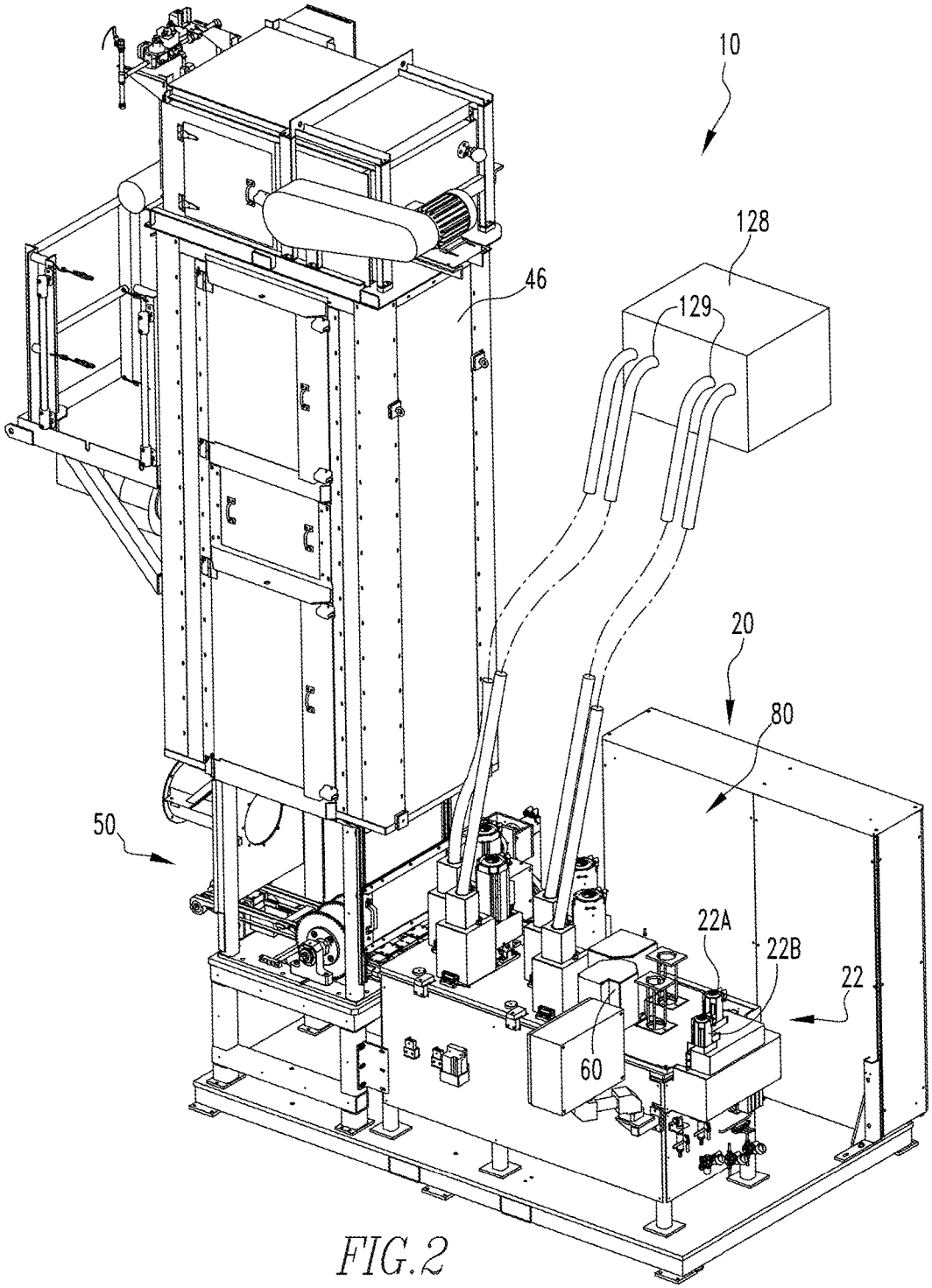
FIG. 2 is an isometric view of a repair machine.

The specific elements illustrated in the drawings and described herein are simply exemplary embodiments of the disclosed concept. Accordingly, specific dimensions, orientations and other physical characteristics related to the embodiments disclosed herein are not to be considered limiting on the scope of the disclosed concept.

As employed herein, the terms "can" and "container" are used substantially interchangeably to refer to any known or suitable container, which is structured to contain a substance (e.g., without limitation, liquid; food; any other suitable substance), and expressly includes, but is not limited to, food cans, as well as beverage cans, such as beer and soda cans.

As employed herein, the term "can end" refers to the lid or closure that is structured to be coupled to a can, in order to seal the can.

As employed herein, the term "can end shell" is used substantially interchangeably with the term "can end." The "can end shell" or simply the "shell" is the member that is acted upon and is converted by the disclosed tooling to provide the desired can end.

As used herein, the term "pull tab" or "tab" refers to an opening device (e.g., opener) made from generally rigid material that has undergone one or more forming and/or tooling operations, and which is structured to be suitably affixed to a can end for the purpose of being pivoted to sever a score line and open at least a portion of the can end.

As employed herein, the term "number" shall mean one or an integer greater than one (i.e., a plurality).

As used herein, a "computer" is a device structured to process data having at least one input device, e.g. a keyboard, mouse, or touch-screen, at least one output device, e.g. a display, a graphics card, a communication device, e.g. an Ethernet card or wireless communication device, permanent memory, e.g. a hard drive, temporary memory, i.e. random access memory, and a processor, e.g. a programmable logic circuit. The "computer" may be a traditional desktop unit but also includes cellular telephones, tablet computers, laptop computers, as well as other devices, such as gaming devices that have been adapted to include components such as, but not limited to, those identified above. Further, the "computer" may include components that are physically in different locations. For example, a desktop unit may utilize a remote hard drive for storage. Such physically separate elements are, as used herein, a "computer."

As used herein, a "computer readable medium" includes, but is not limited to, hard drives, CDs, DVDs, magnetic tape, floppy drives, and random access memory.

As used herein, "permanent memory" means a computer readable storage medium and, more specifically, a computer readable storage medium structured to record information in a non-transitory manner. Thus, "permanent memory" is limited to non-transitory tangible media.

As used herein, "stored in the permanent memory" means that a module of executable code, or other data, has become functionally and structurally integrated into the storage medium.

As used herein, a "file" is an electronic storage means for containing executable code that is processed, or, data that may be expressed as text, images, audio, video or any combination thereof.

As used herein, a "module" is an electronic construct used by a computer and includes, but is not limited to, a computer file or a group of interacting computer files such as an executable code file and data storage files, used by a processor and stored on a computer readable medium. Modules may also include a number of other modules. It is understood that modules may be identified by their purpose of function. Unless noted otherwise, each "module" is stored in permanent memory of at least one computer or computer-like device.

As used herein, "structured to [verb]" when used in relation to a module, or an element containing a module, means that the module, or element including the module, includes executable computer instructions, code, or similar elements that perform the identified task.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, a "coupling assembly" includes two or more couplings or coupling components. The components of a coupling or coupling assembly are generally not part of the same element or construct. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut.

As used herein, a "fastener" is a type of coupling component which is a separate component structured to couple two or more elements. Thus, for example, a bolt is a "fastener" but a tongue-and-groove coupling is not a "fastener." That is, the tongue-and-groove elements are part of the elements being coupled and are not a separate component.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. It is noted that moving parts, such as but not limited to circuit breaker contacts, are "directly coupled" when in one position, e.g., the closed, second position, but are not "directly coupled" when in the open, first position. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof.

As used herein, the phrase "removably coupled" means that one component is coupled with another component in an essentially temporary manner. That is, the two components are coupled in such a way that the joining or separation of the components is easy and would not damage the components. For example, two components secured to each other with a limited number of readily accessible fasteners are "removably coupled" whereas two components that are welded together or joined by difficult to access fasteners are not "removably coupled." A "difficult to access fastener" is one that requires the removal of one or more other components prior to accessing the fastener wherein the "other component" is not an access device such as, but not limited to, a door.

As used herein, "operatively coupled" means that a number of elements or assemblies, each of which is movable between a first position and a second position, or a first configuration and a second configuration, are coupled so that as the first element moves from one position/configuration to the other, the second element moves between positions/configurations as well. It is noted that a first element may be "operatively coupled" to another without the opposite being true.

As used herein. "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are to fit "snugly" together. In that situation, the difference between the size of the components is even smaller whereby the amount of friction increases. If the element defining the opening and/or the component inserted into the opening are made from a deformable or compressible material, the opening may even be slightly smaller than the component being inserted into the opening. With regard to surfaces, shapes, and lines, two, or more, "corresponding" surfaces, shapes, or lines have generally the same size, shape, and contours.

As used herein, "structured to [verb]/[infinitive phrase]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies. As such, as used herein, "structured to [verb or "be an [X]"]" recites structure and not function. Further, as used herein, "structured to [verb or "be an [X]"]" means that the identified element or assembly is intended to, and is designed to, perform the identified verb or to be an [X]. Thus, an element that is only possibly "capable" of performing the identified verb but which is not intended to, and is not designed to, perform the identified verb is not "structured to [verb or "be an [X]" ]." As used herein, the statement that two or more parts or components "engage" one another shall mean that the elements exert a force or bias against one another either directly or through one or more intermediate elements or components.

As used herein, "operatively engage" means "engage and move." That is, "operatively engage" when used in relation to a first component that is structured to move a movable or rotatable second component means that the first component applies a force sufficient to cause the second component to move. For example, a screwdriver may be placed into contact with a screw. When no force is applied to the screwdriver, the screwdriver is merely "coupled" to the screw. If an axial force is applied to the screwdriver, the screwdriver is pressed against the screw and "engages" the screw; however, when a rotational force is applied to the screwdriver, the screwdriver "operatively engages" the screw and causes the screw to rotate.

As used herein, the word "unitary" means a component that is created as a single piece or unit. That is, a component that includes pieces that are created separately and then coupled together as a unit is not a "unitary" component or body.

As used herein, the term "number" shall mean one or an integer greater than one (i.e., a plurality).

As used herein, "about" in a phrase such as "disposed about [an element or axis]" or "extend about [an element or axis]" or "[X] degrees about an [element]," means encircle, extend around, or measured around. When used in reference to a length measurement or in a similar manner, "about" means "approximately."

As used herein, a "path" or "path of travel" is the space an element moves through when in motion.

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, in the phrase "[x] moves between its first position and second position," or, "[y] is structured to move [x] between its first position and second position," "[x]" is the name of an element or assembly. Further, when [x] is an element or assembly that moves between a number of positions, the pronoun "its" means "[x]," i.e. the named element or assembly that precedes the pronoun "its."

As used herein, a "valve" or "valve assembly" includes at least a valve seat and valve member. The valve seat may be in a passage. The valve member moves between a first position, wherein the valve member engages the valve seat, and a second position, wherein the valve member is spaced from the valve seat. When a valve member engages a valve seat no fluid, or substantially no fluid, may pass the valve member.

The following specification uses, as an example, a can 1, FIG. 1, with a generally circular scoreline 6. It is understood that such a can 1 configuration is exemplary only. As such, the exemplary embodiment provided is structured to operate with generally circular can ends 2. This too is an example only and the disclosed and claimed concept is not limited to a single can end configuration. Further, a can end 2 includes a body 3 and a first deformation 4. In an exemplary embodiment, can end body 3 is a generally planar, steel body. As noted above, a deformation 4 may include a rivet and a tab. The can end body 3 has an upper side 5 and a perimeter. In this exemplary embodiment, can end body perimeter is generally circular. The first deformation 4 is disposed on the can end body upper side 5 and adjacent the can end body scoreline 6. In an exemplary embodiment, the first deformation includes a rivet 7 and a tab 8.

Further, in an exemplary embodiment, the rivet 7 includes a generally cylindrical post (not shown) having an upper surface 9. Further, the rivet upper surface 9 may include an indicia 9'. In an exemplary embodiment, the indicia 9' includes marks indicating an orientation and other characteristics of the deformation. For example, the indicia 9' may be a symbol such as a "+" sign wherein the vertex thereof is at the center of the rivet. Further, the length of the bars of the "+" may be related to the radius of the rivet 7. Such information may be used, as described below, to better identify the proper location for applying the repair fluid.

As shown in FIGS. 2-4 and 8-9, a repair machine 10 is provided. The repair machine 10 is structured to apply a repair fluid to a plurality of can ends 2. The repair machine 10 includes a housing assembly 12, a can end down stacker assembly 20, a can end conveyor assembly 30, and a spray assembly 50 and an oven assembly 46 (FIG. 1). Generally, a can end 2 moves from the can end down stacker assembly 20 onto the can end conveyor assembly 30 which transports the can end 2 through the spray assembly 50 and into the oven assembly 46. The process flows, therefore is from, as used herein, an "upstream" location to a "downstream" location wherein "upstream" locations are located closer to the can end down stacker assembly 20 and "downstream" locations are located closer to the oven assembly 46.

The can end down stacker assembly 20 (shown schematically) is known and is structured to move individual can ends 2 from a stack 22 to the can end conveyor assembly 30. In an exemplary embodiment, the can end down stacker assembly 20 drops the can ends 2 onto the can end conveyor assembly 30. Further, in this example, the can end down stacker assembly 20 includes two stacks 22A, 22B of can ends 2 that are spaced from each other and disposed laterally to each other relative to the axis of motion of the conveyor belts 34A, 34B, described below. In an exemplary embodiment, the can ends 2 are disposed in the stacks 22A, 22B in a random orientation. That is, generally, the deformations 4 on adjacent can ends 2 are not aligned. In this configuration, the can end down stacker assembly 20 alternately drops a can end 2 on each conveyor belt 34A, 34B. It is noted that a repair machine 10 with two stacks 22A, 22, i.e. a "two-out" machine is only exemplary; the disclosed concept is operable with any number of stacks 22.

Figure 4:
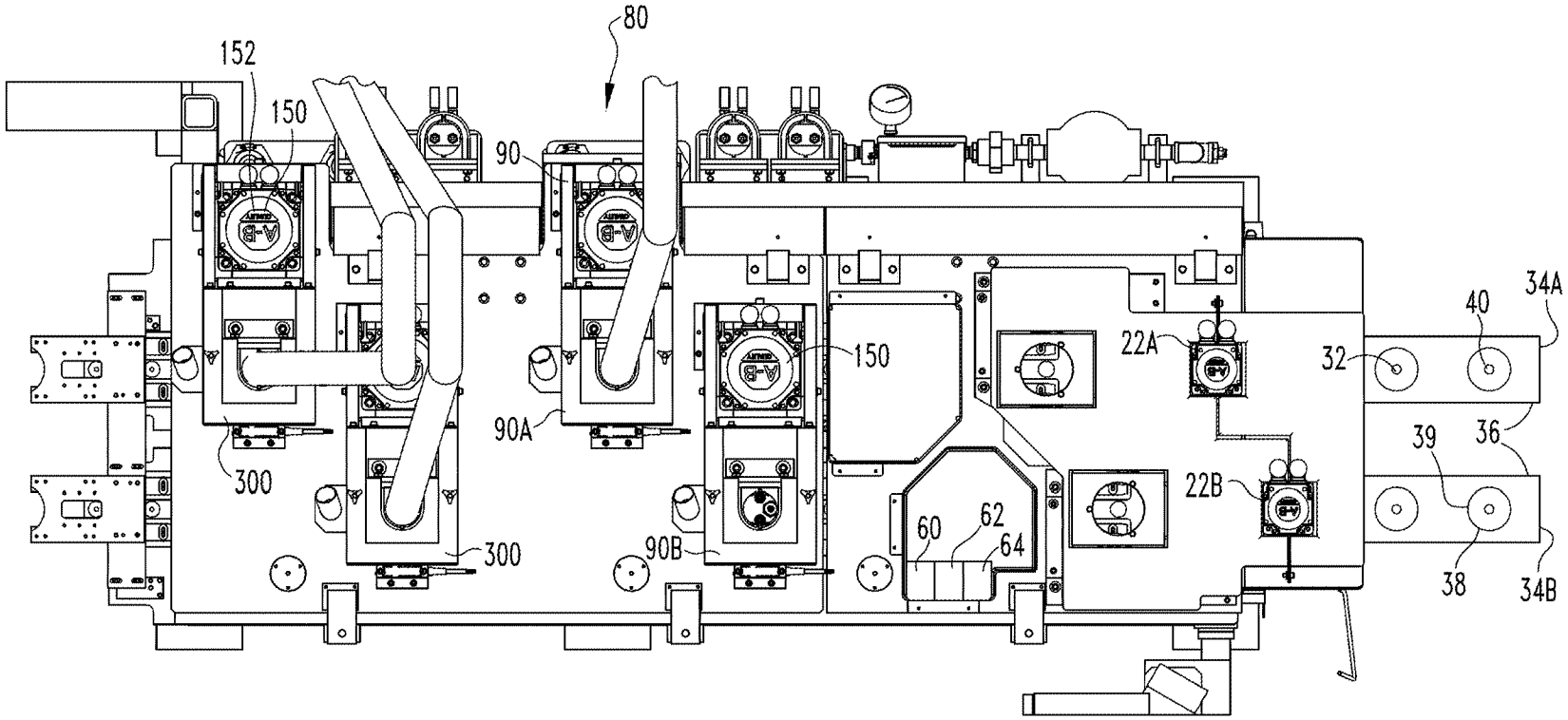
FIG. 4 is a partial top view of a repair machine.

As shown best in FIG. 4, the can end conveyor assembly 30 is structured to transport can ends 2 over a path. The can end conveyor assembly 30 includes a number of reference locations 32. In an exemplary embodiment, the can end conveyor assembly 30 includes a number of conveyor belts 34A, 34B (two shown, generally identified by reference number 34). A conveyer belt 34 includes a flexible, generally planar body 36 formed into a loop. In an exemplary embodiment, the outer surface of the looped conveyor belt body 36 includes a number of recesses 38 that are shaped and sized to correspond to the can ends 2. Thus, in this example and as shown, the recesses 38 are generally circular. Further, within each recess 38 is a magnet 40. In an exemplary embodiment, the magnet 40 is disposed generally at the center of each recess 38. In an exemplary embodiment, the center of each recess 38 is also reference location 32. Further, the can end conveyor assembly 30 is structured to move the belt 34 in an intermittent, or indexed, motion. That is, each belt moves a set distance then stops before moving the set distance again. As used herein, each recess 38 has a forward-most location 39, which is identified as the "12:00 o'clock position," located leading edge of the recess 38 and along the axis of motion of the associated conveyor belt 34A, 34B. The can end conveyor assembly 20 is disposed adjacent to the can end down stacker assembly 20 and receives can ends 2 therefrom.

In this configuration, and as discussed above, the can end down stacker assembly 20 alternately drops a can end 2 on each conveyor belt 34A, 34B. The conveyor belts 34A, 34B are stopped when a can end 2 is dropped from the can end down stacker assembly 20; thus, the conveyor belts 34A, 34B move alternately. When a can end 2 drops from the can end down stacker assembly 20, the can end 2 falls into a recess 38 and is held in place by the magnet 40. Because the can ends 2 are randomly oriented in the can end down stacker assembly 20, the can ends 2 are randomly oriented on the conveyor belts 34A, 34B.

It is noted that in this configuration, i.e. planar conveyor belts 34A, 34B with recesses 38, the can ends 2 substantially move over the same path. That is, the center of each can end 2 generally is disposed over the longitudinal axis of the associated conveyor belt 34 and over the associated reference location 32, i.e., the center of the recess 38 in which the can end 2 is disposed. Thus, the location of each deformation 4, in this exemplary embodiment, may be expressed as an orientation relative to the associated reference location 32. For example, the deformation on one can end 2 may be said to be at the "3:00 o'clock" position or at a "ninety degree" position (that is ninety degrees about the rivet 7 from the forward most location 39), whereas another can end 2 may have a deformation at the "7:00 o'clock" position or at a "two-hundred and ten degree" position (that is two-hundred and ten degrees about the rivet 7 from the forward most location 39).

It is further understood that this is one example of a can end conveyor assembly 30. In another example, not shown, a conveyor belt does not have recesses and includes reference locations forming a grid on the upper surface of the conveyor belt. The grid locations may be expressed as Cartesian coordinates. In this example, the can ends fall onto random locations on the conveyor belt and the location of the deformation 4 may be expressed in terms of the conveyor belt's Cartesian coordinates.

The oven assembly 46, FIG. 1, which is known, is structured to cure the repair fluid. That is, the oven assembly 46 includes a can end transporter (not shown) that receives can ends 2 from the can end conveyor assembly 30 and moves the can ends 2 through a heated chamber (not shown.)

The spray assembly 50 is structured to apply a repair fluid to a can end deformation 4. The spray assembly 50, in an exemplary embodiment, includes a locator assembly 60, a deformation spray gun assembly 80 (hereinafter "spray gun assembly" 80), a motion assembly 150, and a control assembly 200. The spray assembly 50 may further include a scoreline spray gun assembly 300 which is structured to apply a repair fluid to a can end scoreline as described in U.S. Pat. No. 8,584,615, with is incorporated by reference. Further, the spray gun assembly 80 and the scoreline spray gun assembly 300 may share selected elements, such as but not limited to elements of the repair fluid supply system 128, shown schematically, FIG. 3.

Generally, and for the can end conveyor assembly 30 described above, the locator assembly 60 is structured to determine the orientation of the can end deformation 4 relative to the associated reference locations 32. The locator assembly 60 provides information as to the orientation of the can end deformation 4 to the control assembly 200. The control assembly 200 is structured to actuate the motion assembly 150 so as to position the spray gun assembly 80 in an application orientation relative to the first deformation 4. The spray gun assembly 80 is then actuated and a repair fluid is applied to the first deformation 4.

Further, as described in the embodiments below, selected elements transmit and/or receive electronic signals including data. This data is processed by computers, or computer-like elements. As used herein, "computer-like elements" means a limited number of elements associated with a computer (as noted above); for example, a programmable logic circuit, with associated memory devices and modules, as well as input and output devices, but without human interface devices are "computer-like elements." As is known, the physical locations of the computers, or computer-like elements, is not relevant. That is, a computer that controls, for example, a camera, may be disposed on the camera or at a remote location spaced from the camera. As such, it is understood that, the computers, or computer-like elements, do not have to be physically coupled to other elements of the identified assembly. Further, it is understood that when a computer or computer-like element is said to be "structured to [verb]," it means that the computer or computer-like element includes a module that is "structured to [verb]."

In an exemplary embodiment, the locator assembly 60 is structured to determine the location of the first deformation 4 relative to a can end conveyor assembly reference location 32 and to provide a location signal. As used herein, a "location signal" is an electronic construct that includes data representing the location of the first deformation 4 relative to a can end conveyor assembly reference location 32 for each can end 2 that is processed. The locator assembly 60 in one exemplary embodiment, not shown, utilizes an electromagnetic sensor to detect both the magnet 40 and the first deformation 4. In the embodiment shown, the locator assembly 60 includes a camera 62 and a programmable logic circuit 64 with associated memory and programming modules (shown schematically, and represented collectively as part of the programmable logic circuit 64).

In an exemplary embodiment, the camera 62 is a digital camera including a digital image sensor, such as but not limited to a charge-coupled device (CCD) or a complementary metal-oxide-semiconductor (CMOS). The camera 62 is structured to provide image data. As used herein, "image data" is data that represents the image captured by the camera 62. The camera 62 is electronically coupled to the locator assembly programmable logic circuit 64 and provides the image data thereto. The locator assembly programmable logic circuit 64 is, in an exemplary embodiment, a computer-like element structured to receive the image data, convert the image data to location data, and to provide a location signal. Alternatively, the locator assembly programmable logic circuit 64 may simply incorporate the image data into a signal that becomes the location signal. That is, the locator assembly programmable logic circuit 64 does not have to convert the image data to location data as the image data may contain sufficient information to be location data.

In another exemplary embodiment, wherein the rivet 7 includes an indicia 9', the locator assembly programmable logic circuit 64 is structured to recognize the indicia 9' and to convert image data of the indicia 9' to location data. In this embodiment, the location data includes additional information, such as, but not limited to, the location of the center of the rivet 7 and size of the rivet 7. It is understood that the locator assembly programmable logic circuit 64 is structured to covert the image data of the indicia 9' into the additional location information. Thus, the locator assembly 60 is structured to determine the location of a rivet 7. Generally, the locator assembly 60 is structured to determine the location of a rivet 7 as an orientation relative to the reference location 32, i.e. the rivet 7 is disposed at the "3:00 o'clock" position or at a "ninety degree" position (that is ninety degrees about the rivet 7 from the forward most location 39). In an exemplary embodiment, the locator assembly 60 is structured to determine the location of a rivet 7 within approximately one degree.

Figure 5:
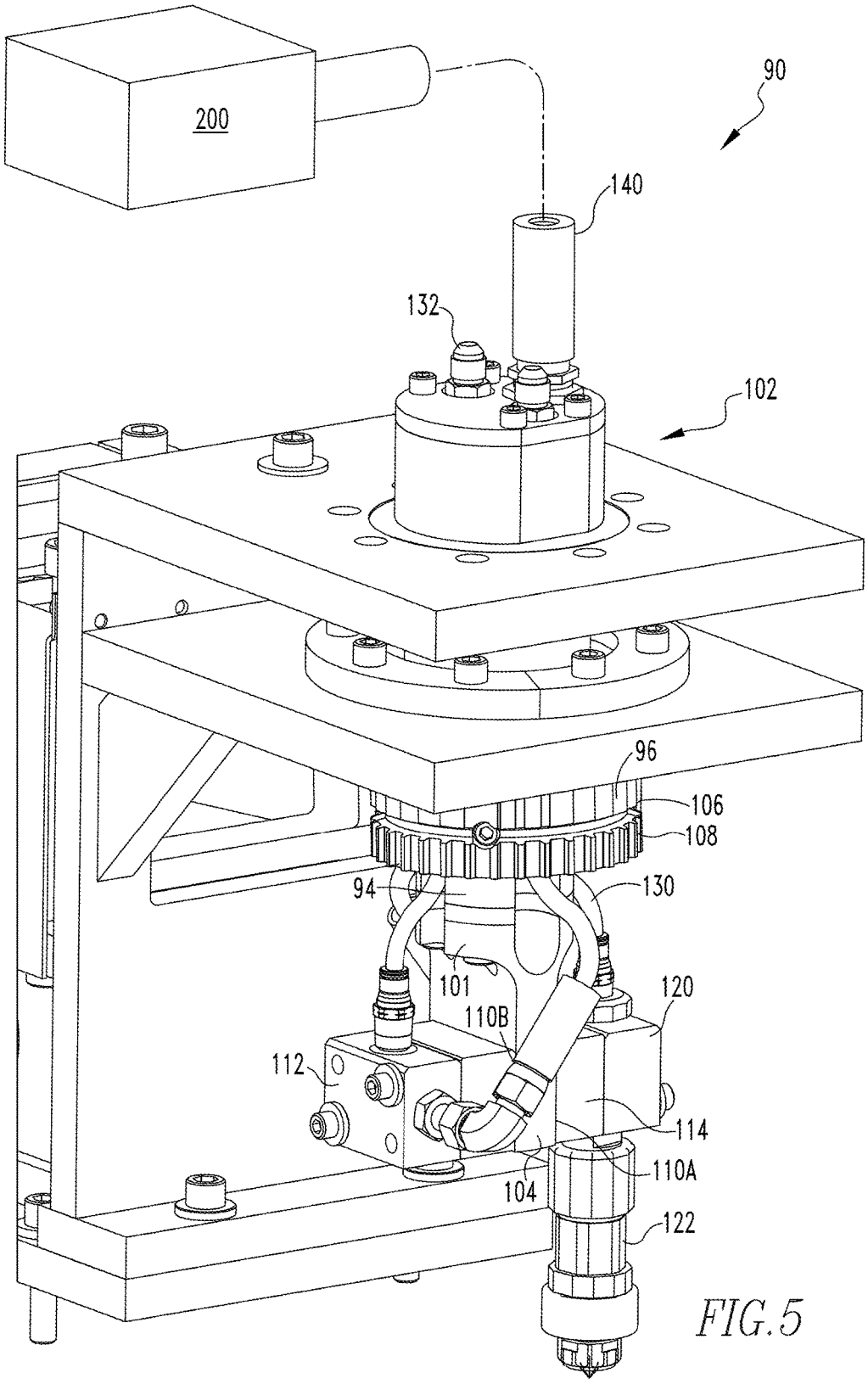
FIG. 5 is an isometric view of an embodiment of a spray head.
Figure 6:
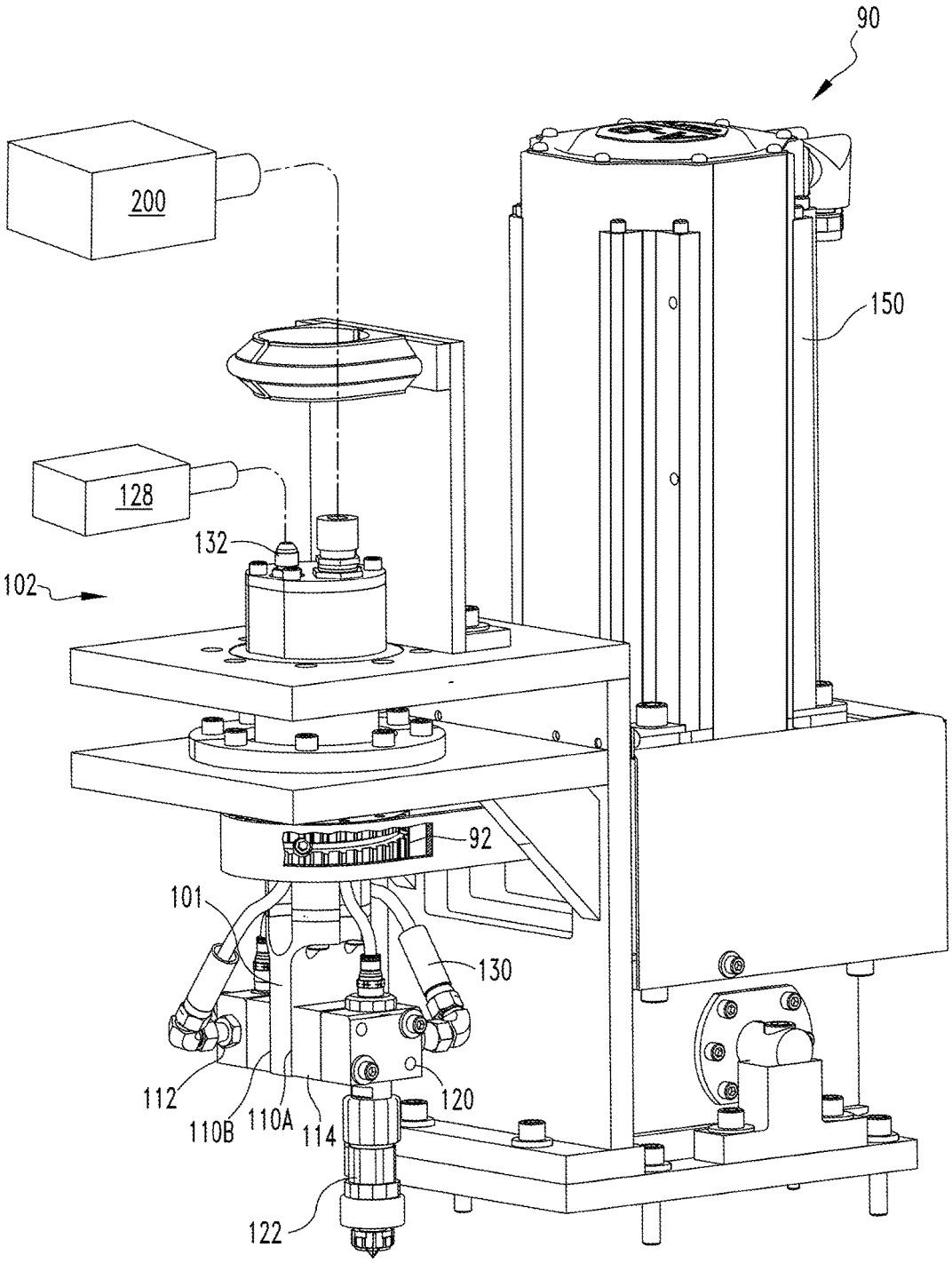
FIG. 6 is an isometric view of another embodiment of a spray head.
Figure 7:
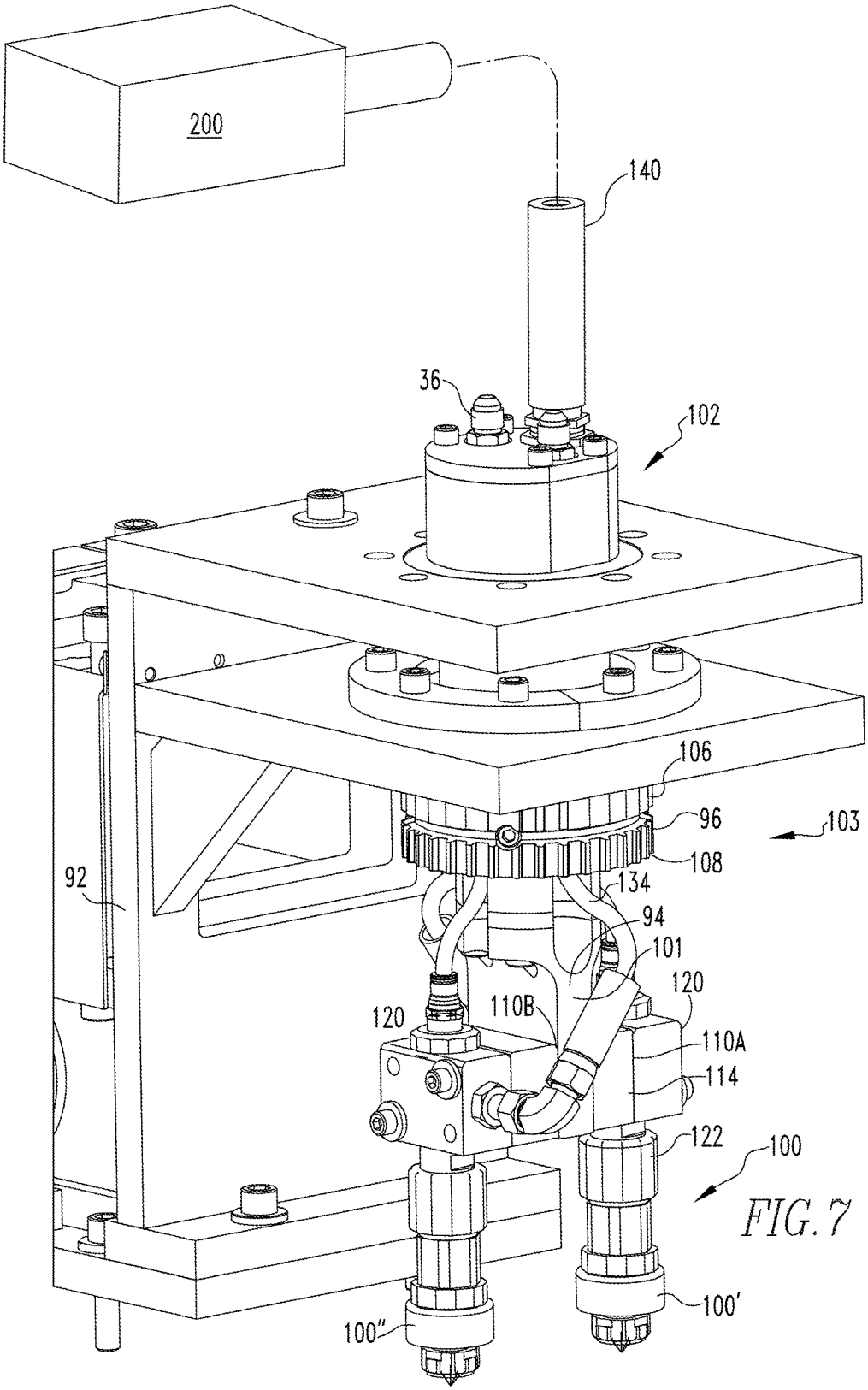
FIG. 7 is an isometric view of another embodiment of a spray head.
Figure 8:
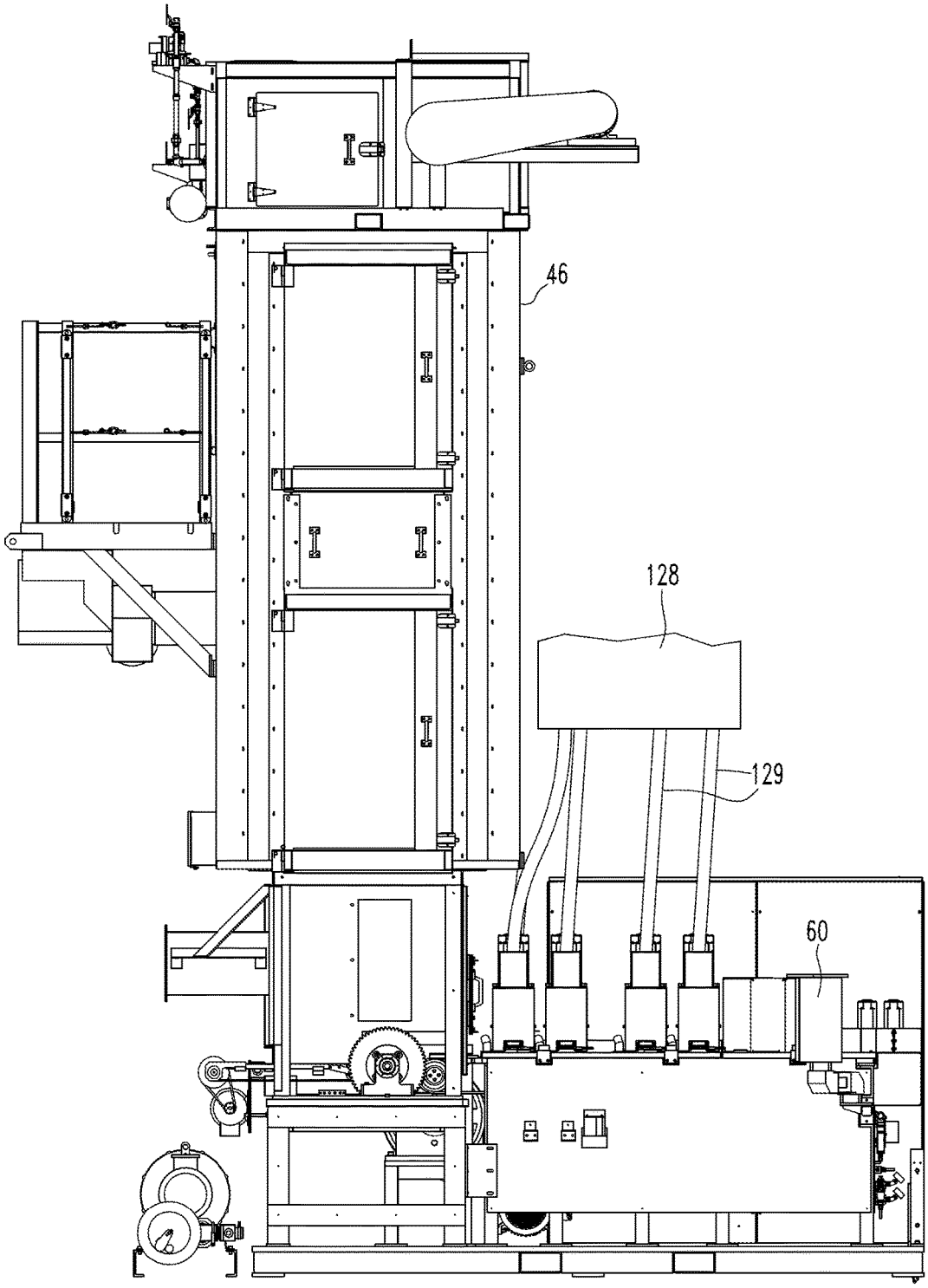
FIG. 8 is side view of a repair machine.
Figure 9:
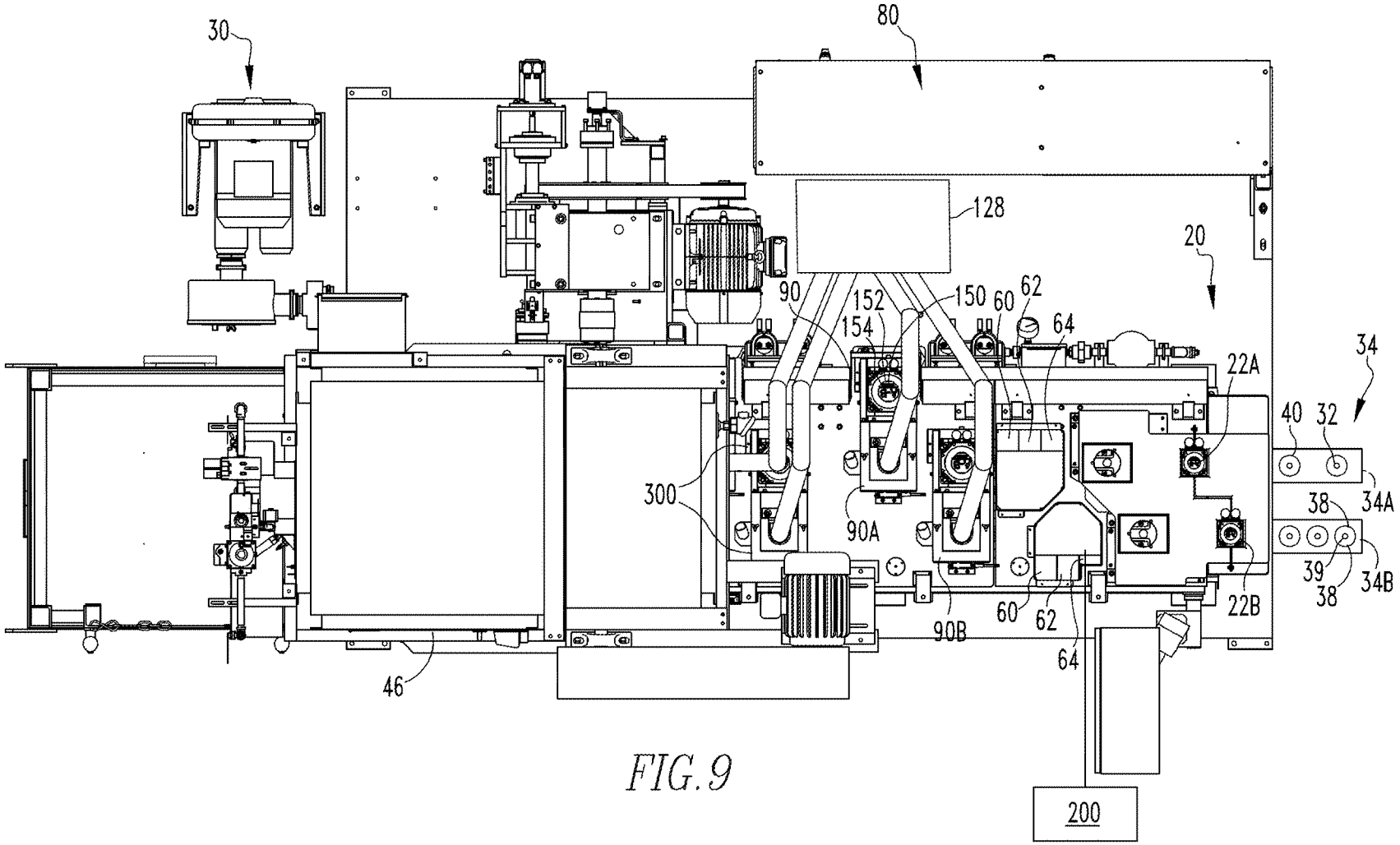
FIG. 9 is a top view of a repair machine.

The spray gun assembly 80 is described next as the configuration and operation of the motion assembly 150 and a control assembly 200 are more understandable in view of the configuration and operation of the spray gun assembly 80. In an exemplary embodiment, the spray gun assembly 80 is similar to the spray assembly of U.S. Pat. No. 8,584,615. That is, as shown in FIGS. 5-7, the spray gun assembly 80 includes a number of spray heads 90. In an exemplary embodiment, there is one spray head 90 associated with each conveyer belt 34. As the spray heads 90 are substantially similar, only one will be described. Each spray head 90 includes a mounting member 92, a pivot member 94 a transfer member 96 and a number of spray guns 100. The mounting member 92 is structured to couple, directly couple, or fix the spray head 90 to the repair machine housing assembly 12 adjacent a conveyer belt 34 path of travel.

The pivot member 94 includes an elongated body 101 with a first end 102, a medial portion 103, and a second end 104. The pivot member body first end 102 is movably coupled to the mounting member 92. In this exemplary embodiment, the pivot member body first end 102 is rotatably coupled to the mounting member 92 and the pivot member body 101 rotates about an axis of rotation that is generally aligned with the pivot member body 101 longitudinal axis.

In an exemplary embodiment, the pivot member body 101 also includes a transfer member 96. The transfer member 96 is structured to transfer a motion to the pivot member 94. In an exemplary embodiment, the transfer member 96 includes a body 106 having an engagement surface 108. The transfer member body engagement surface 108 is, in an exemplary embodiment, structured to be engaged by a toothed drive belt 154, described below. The transfer member 96 is coupled, directly coupled, or fixed to the pivot member body medial portion 103. In an exemplary embodiment, the transfer member 96 is fixed to the pivot member body medial portion 103. The transfer member 96 is structured to transfer a predetermined motion that is induced by the motion assembly 150 and controlled by the control assembly 200.

The pivot member body second end 104 is structured to be coupled, directly coupled, removably coupled, or fixed to a number of spray guns 100. In this configuration each spray gun 100 rotates with the pivot member 94. In an exemplary embodiment, the pivot member body second end 104 defines a number of radial mounting portions 110 disposed on the radial surface of the pivot member body second end 104. In another embodiment, not shown, the pivot member body second end 104 defines a number of axial mounting portions disposed on the axial surface of the pivot member body second end 104. Each mounting portion 110 includes a number of coupling components (not shown) that correspond to coupling components (not shown) on the spray guns 100 or a counterweight 112, FIG. 5.

Further, in an exemplary embodiment, the pivot member body second end 104 includes spacers 114. The spacers are structured to be removably coupled to the mounting portions 110 as well. The spacers 114 include sets of spacers 114 of different sizes. As described below, the spacers 14 may be disposed between the pivot member body second end 104 and a spray gun 100. Thus, the radial width of a spacer, when mounted on the pivot member body second end 104, determines the radial position of the spray gun 100 relative (or a counterweight 112) to the pivot member 94 axis of rotation. Each spacer 114 includes a first coupling (not shown) structured to be coupled to a pivot member body second end mounting portion 110, and, a second coupling structured to be coupled to a spray gun 100.

Each spray gun 100 is structured to apply the repair fluid to a can end deformation 4. That is, each spray gun 100 is structured to apply the repair fluid to a localized area. As used herein, a "localized area" is an area that is less than half the area of the can end and which does not form a circle or a major arc. That is, a "localized area" includes an application to a point, or an area disposed about a point, which occurs when the can end and spray gun 100 are stationary. A "localized area" includes an application over a minor arc which occurs when the either or both can end and spray gun 100 are not stationary. Thus, a spray gun 100 is capable of applying a repair fluid to a "localized area" when the spray gun 100 is either stationary or in motion.

Each spray gun 100 is structured to apply the repair fluid in an application pattern. An "application pattern" has characteristics defining the type of repair fluid application, i.e. either a stream or a mist, and the shape of the spray. As used herein a "stream" of repair fluid is generally a continuous flow of a fluid, but also includes a single, relatively large drop of repair fluid. A "mist" of repair fluid is a plurality of droplets including atomized droplets. Each spray gun 100 is further structured to apply the repair fluid in a stream having any of a number of shapes including, generally cylindrical, generally flat, a full, generally conical shape, or a hollow, generally conical shape.

Each spray gun 100 includes a housing assembly 120, a nozzle 122 and an electronically controlled valve assembly (not shown). Alternatively, a valve assembly may be disposed on another part of the repair fluid supply system 128, described below. Each spray gun is substantially similar and only one will be described. A spray gun housing assembly 120 includes a coupling (not shown) that is structured to be coupled to either a pivot member body second end mounting portion 110, or, to a spacer 114. The housing assembly 120 defines a passage (not shown) or the repair fluid. The passage is in fluid communication with the nozzle 122. Each nozzle 122 is structured to apply the repair fluid as described above. Various configurations of spray guns 100 are discussed more below.

Figure 3:
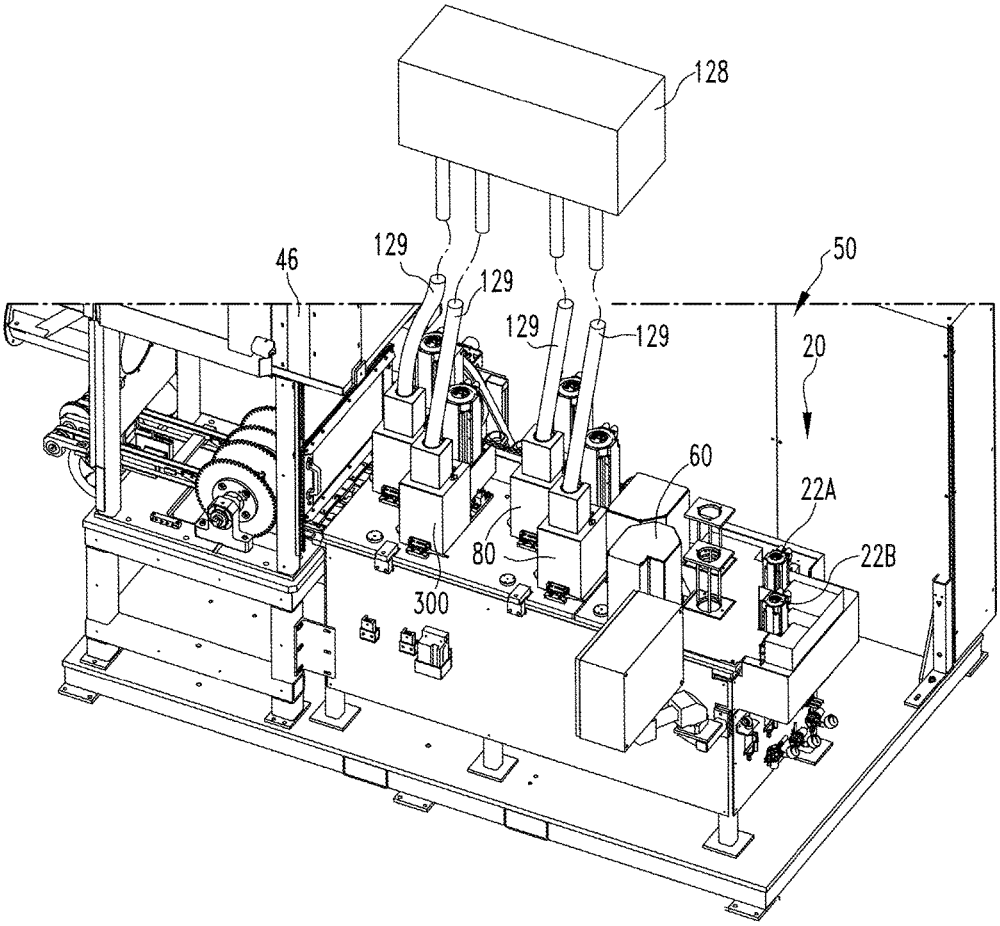
FIG. 3 is a partial isometric view of a repair machine.

Each spray head 90 is coupled to and in fluid communication with a repair fluid supply system 128, FIG. 3, shown schematically. As is known, the repair fluid supply system 128 includes storage assemblies for the repair fluid, pumps and/or pressure systems, and other control elements (none shown). The repair fluid supply system 128 includes supply hoses 129 (shown schematically) that transport the repair fluid from the fluid supply system storage assemblies to the spray heads 90. The spray heads 90 are structured to be coupled to, and in fluid communication with, the repair fluid supply system 128. For example, in an embodiment with spray guns 100 (FIG. 7) a spray head 90 includes a first supply line 130 having a first fluid connector 132, a second supply line 134 having a second fluid connector 136, and a single control cable 140 having an control connector 142. The first and second fluid connectors 132, 136 for the first and second supply lines 130, 134, respectively, and the control connector 142 for the control cable 140, are advantageously all disposed at the pivot member body first end 102. Among other benefits, this eliminates the need to use a rotary union or other rotating mechanical joint as well as the need for a rotary electrical joint, thereby substantially reducing the complexity of the design and significantly improving the ability to relatively quickly and easily modify each spray head 90. That is, each spray head 90 does not have a rotating mechanical joint and/or a rotary electrical joint. In addition, having all of the connections 132, 136, 142 at one location provides for relatively easy and quick changeover of the spray guns 100. It is understood that the first and second fluid connectors 132, 136 are coupled to, and are in fluid communication with, repair fluid supply lines (not shown). The control connector 142 is coupled to, and is in electronic communication with, the control assembly 200. It is understood that in an embodiment with one nozzle 122 (FIGS. 5 and 6), the "second" supply line and associated elements are absent.

The motion assembly 150, shown best in FIG. 4, is structured to impart motion to each spray head 90. That is, the motion assembly 150 is structured to receive an orientation signal and, in response to the orientation signal, to position a gun assembly 100 in an application orientation relative to a first deformation 4. As used herein, an "application orientation" is a position wherein a spray gun 90 is disposed so as to apply a repair fluid in a "localized area." Thus, an "application orientation" depends upon the application pattern provided by the spray gun 100. In an exemplary embodiment, the orientation signal includes data representing the direction of rotation and the amount of rotation to be provided by the servo motors 152, discussed below.

In an exemplary embodiment, the motion assembly 150 includes a number of reversible servo motors 152 (FIG. 4, shown schematically), and a number of toothed drive belts 154. In an alternative embodiment, the motion assembly 150 includes a cam box (not shown) as described in U.S. Pat. No. 8,584,615. Each servo motor 152 includes an output shaft (not shown) that selectively rotates in either a clockwise or counterclockwise direction. The timing and direction of rotation is controlled by the control assembly 200. Each drive belt 154 is operatively coupled to the servo motor output shaft and to each transfer member 96. In this configuration, the motion assembly 150 is structured to impart a rotational motion to each pivot member body 101. Moreover, the timing and direction of rotation of each pivot member body 101 is, therefore, controlled by the control assembly 200.

It is noted that, while the fluid supply lines (not shown) can accommodate some twisting, the fluid supply lines cannot be over twisted. Thus, as the fluid supply lines rotate with each spray head 90, the rotational motion of each spray head 90 is limited. That is, in an exemplary embodiment, the control assembly 200 is structured to limit the rotation of the pivot member 94 as described below.

The motion assembly 150 described above is structured to be used with a conveyor assembly 30 including a conveyor belt 34 with recesses 38. In another embodiment, not shown, the motion assembly 150 is structured to move the spray head(s) (not shown) over a confined plane. That is, the motion assembly 150 includes a two-axis movement assembly (not shown). That is, the two-axis movement assembly includes a first movement assembly that is structured to position a spray head at a selected coordinate along a first axis, e.g. a X-axis, and a second movement assembly that is structured to position a spray head at a selected coordinate along a second axis, e.g. a Y-axis. The plane defined by the X, Y axes is generally parallel to the plane of the path defined by a conveyor belt or another can end conveyor assembly 30. This embodiment of the motion assembly 150 could, for example, be used with a can end conveyor assembly 30 including a belt having reference locations forming a Cartesian coordinates grid on the upper surface of the conveyor belt.

The control assembly 200 is structured to control the motion assembly 150 and the timing of the application of repair fluid, i.e. control the spray guns 100. The control assembly 200 is structured to move each spray gun assembly 80, i.e. rotate the pivot member 94 of each spray gun assembly 80, according to a predetermined motion. The predetermined motion is a limited oscillating motion. As used herein, a "limited oscillating motion" means that the pivot member 94 rotates within a limited range or a very limited range. As used herein, a "limited range" of rotational motion is a motion limited to travel over about 720°, and, a "very limited range" is about 360°. That is, during the calibration procedure, the fluid supply lines (not shown) are positioned so that they are not twisted. The control assembly 200 records this position as a neutral or center position. The control assembly 200 further includes rotation limit data representing a first stop and a second stop. The first and second stops are 360° from the center position if the "limited oscillating motion" is a "limited range," and, 180° from the center position if the "limited oscillating motion" is a "very limited range."

By way of example, assume that three can ends 2 are passing under a spray head 90, as described below. The deformations on the can ends 2 are located, in order, at about the 3:00 o'clock, 4:00 o'clock, and 7:00 o'clock positions. Further, assume the center position of the pivot member 94 corresponds to a spray gun 100 being disposed over the recess forward-most location 39, i.e. 12:00 o'clock position. This is also the starting location for the spray gun 100. Further, the exemplary spray gun assembly 80 is structured to have a "limited oscillating motion" within a "very limited range." That is, the first stop is at +180° and the second stop is at −180° from the center position. In this example, the pivot member 94, and therefore the spray gun 100, would rotate from the 12:00 o'clock position to the 3:00 o'clock (+90°) to apply repair fluid to the first can end. The pivot member 94, and therefore the spray gun 100, would then rotate from the 3:00 o'clock position to the 4:00 o'clock (+ and additional 30°, to the 120°) to apply repair fluid to the second can end. Then, even though the deformation 4 on the third can end is only another 90° in the forward direction, such a motion would move the pivot member 94 past the first stop. Thus, the pivot member 94, and therefore the spray gun 100, would then rotate counterclockwise from the 4:00 o'clock position to the 7:00 o'clock (−270°, to be −150° from the center position) to apply repair fluid to the third can end. It is noted that, as used herein, a "limited oscillating motion" does not mean that the rotation reverses direction with each movement. Thus, the control assembly 200 is structured to track the orientation of the pivot member 94 and, store in memory, the control assembly 200 includes rotation limit data indicating a first rotation stop and a second rotation stop. Further, the predetermined motion is a limited oscillating motion between the first rotation stop and the second rotation stop.

The control assembly 200 (shown schematically), in an exemplary embodiment, includes computer-like elements including a programmable logic circuit, with associated memory devices and modules, as well as input and output devices (none shown). The control assembly 200 is structured to receive a location signal from the locator assembly 60, to convert the location signal to orientation data, and to provide an orientation signal to the motion assembly 150. Thus, the control assembly 200 is in electronic communication with both the locator assembly 60 and the motion assembly 150.

Further, the control assembly 200 is in electronic communication with the spray gun 100 valve. The control assembly 200 is structured to provide a command to open and close the valve when the spray gun 100 is in an application orientation relative to the deformation 4 of the can end 2 being repaired.

A spray head 90 may be assembled in a number of configurations. Some characteristics that may be changed include the number of spray guns 100, and the angle of the nozzle 122. While every specific combination of these variable characteristics is not described, it is understood that a spray head 90 may include any combination of these characteristics.

In one exemplary embodiment, shown in FIG. 5, a spray head 90 includes a single, radially mounted spray gun 100. In this embodiment, the spray head 90 includes a counterweight 112. That is, a spray gun 100 is coupled to a first radial mounting portion 110A and the counterweight 112 is coupled to a generally opposite second radial mounting portion 110B. As used herein, and in reference to elements coupled to a rotating element having an axis of rotation, "generally opposite" means the elements are disposed about 180° from each other about the axis of rotation. In this configuration, the spray head 90 is substantially balanced when the pivot member 94 rotates. In this configuration, the pivot member 94, and therefore the spray gun 100, rotate at least 360°. In this embodiment, the spray gun nozzle 122 may be structured to produce an application pattern of repair fluid that moves generally parallel to the pivot member 94 axis of rotation, or, an application pattern of repair fluid that moves generally at an angle to the pivot member 94 axis of rotation.

In another embodiment, shown in FIG. 6, a spray head 90 includes a single, axially mounted spray gun 100. Because the deformation 4 is not located at the center of the can end 2, the spray gun nozzle 122 is structured to produce an application pattern of repair fluid that moves generally at an angle to the pivot member 94 axis of rotation. In this embodiment, no counterweight 112 is needed. Further, in an exemplary embodiment, the spray gun housing assembly 120 includes an angle adjustment assembly (not shown). The angle adjustment assembly is structured to adjust (change) the angle of the nozzle 122 relative to the pivot member 94 axis of rotation. The angle adjustment assembly, in an exemplary embodiment, includes a preset device whereby the angle of the nozzle 122 may be set at a number of preselected angles.

Thus, the spray gun assembly 80 is structured to produce a stream of fluid that is one of either a stream that is generally parallel to the pivot member axis of rotation, or, that is generally at an angle relative to the pivot member axis of rotation.

In another embodiment, shown in FIG. 7, a spray head 90 includes two spray guns 100', 100". The spray guns 100 are each coupled to one of two opposing radial mounting portions 110A, 110B. Further, as an example, in this embodiment, a spacer 114 is disposed between each spray gun 100 and the pivot member 94. As before, the spray gun nozzle 122 may be structured to produce an application pattern of repair fluid that moves generally parallel to the pivot member 94 axis of rotation, or, an application pattern of repair fluid that moves generally at an angle to the pivot member 94 axis of rotation. Further, in this embodiment, the control assembly 200 is structured to limit the rotation of the pivot member 94 to a proportional arc.

That is, with multiple spray guns 100, no gun is required to move over more than 180° in order to provide the spray head 90 with access to 360° of the can end 2. Thus, each spray gun 100 only needs to move over a "proportional arc." As used herein, a "proportional arc" is an arc extending over about 360°/N, wherein "N" is the number of spray guns 100. Thus, if there are two spray guns 100, the "proportional arc" is about 180°. If there are three spray guns 100, the "proportional arc" is about 120°. It is understood that, for reasons related to balance, the spray guns 100 are generally evenly spaced about the pivot member 94 axis of rotation.

In another embodiment, a spray head 90 includes a two spray guns 100. The spray guns 100 are each coupled to one of two opposing radial mounting portions 110. As before, the spray gun nozzle 122 may be structured to produce an application pattern of repair fluid that moves generally parallel to the pivot member 94 axis of rotation, or, an application pattern of repair fluid that moves generally at an angle to the pivot member 94 axis of rotation. In this embodiment, the spray guns 100 are not limited to a proportional arc, but still move in a limited oscillating motion. In this embodiment, each spray gun 100 moves into an application orientation while still in motion. Further, each spray gun 100 applies the repair fluid. That is, the deformation receives two applications of repair fluid, one from each spray gun 100.

The repair machine 10 is assembled as follows. The can end down stacker assembly 20 is disposed at the upstream end of the conveyor assembly 30. The spray assembly 50, which includes two spray heads 90A, 90B, is disposed over the conveyor belts 34A, 34B of the conveyor assembly 30. In an exemplary embodiment, a scoreline spray gun assembly 300 is disposed either upstream or downstream of the spray gun assembly 80. The downstream end of the conveyor assembly 30 is disposed at the oven assembly 46. Further, within the spray assembly 50, the locator assembly 60 is disposed upstream of each spray head 90A, 90B.

The repair machine 10 operates as follows. Again, noting that the can end conveyor assembly 30 is structured to move the belt 34 in an intermittent, or indexed, motion, the can end down stacker assembly 20 deposits a can end 2 onto a conveyor belt 34 as described above. The can end 2 is substantially secured, i.e. the can end 2 cannot rotate, within the conveyor belt recess 38 by a magnet 40. A can end 2 is deposited in a series of consecutive conveyor belt recesses 38. As noted above, the deformation 4 on each can end 2 is in a random orientation.

As the conveyor belt 34 moves forward a number of stops, each can end 2 moves adjacent, and in an exemplary embodiment under, the locator assembly 60. The locator assembly 60 determines the location, and in this embodiment the orientation, of each deformation 4 relative to the reference location 32. That is, for example, the locator assembly 60 may determine that the first three deformations 4 are disposed at the 3:00 o'clock, 4:00 o'clock, and 7:00 o'clock positions, respectively. This information is recorded as location data and incorporated into a location signal. The location signal is provided to the control assembly 200.

As the conveyor belt 34 moves forward, the first can end 2 moves adjacent to the spray gun 100, i.e. one stop before the spray gun 100. The control assembly 200 receives the location signal, converts the location signal to orientation data and produces an orientation signal including data representing the direction of rotation and the amount of rotation to be provided by the servo motor 152. The orientation signal is transmitted to the motion assembly 150 which actuates the servo motors 152 as, or before, the can end moves into position, and in this example, under, the spray head 90. That is, upon receiving the orientation signal, the motion assembly 150 adjusts the position of the spray gun 100 to be in an application orientation for the first can end 2. The control assembly 200 further provides a command to the spray gun valve to actuate and provide repair fluid to the nozzle 122. The repair fluid is then applied to a localized area on the can end and, in an exemplary embodiment, to the rivet 7. It is noted that the rotation of the spray gun 100 may be arrested prior to application of the repair fluid, but this is not required.

It is understood that while the first can end is moving toward, or is at, the spray head 90, the second and third can ends are moving adjacent to the locator assembly 60 and the orientation of each of the deformations on those can ends are being determined, recorded, and provided to the control assembly 200 as a location signal. Thus, as each of the second and third can end moves into position under the spray head 90, the process described above is repeated and the spray gun is moved into an application orientation for each can end 2.

After the repair fluid is applied to each deformation 4, and each scoreline, if a scoreline spray gun assembly 300 is included, the can ends are moved into the oven assembly 46 for curing.

In another embodiment, the deformation spray gun assembly 80 is combined with a scoreline spray gun assembly 300 (combination not shown). In this embodiment, a spray head 90, in an exemplary embodiment, includes two spray guns structured to apply repair fluid to a scoreline as described in U.S. Pat. No. 8,584,615, as well as a number of spray guns 100 structured to apply repair fluid to a deformation 4. In an exemplary embodiment, there are two spray guns 100 structured to apply repair fluid to a deformation 4. Thus, there are two scoreline spray guns coupled to opposing pivot member radial mounting portions 110 and two deformation spray guns coupled to opposing pivot member radial mounting portions 110. In this configuration, the spray head 90 applies repair fluid to the scoreline as described in U.S. Pat. No. 8,584,615 and applies repair fluid to the deformation 4 as described herein. The application of repair fluid to the scoreline or the deformation 4 may occur in sequence (in any order) or at the same time. Alternatively, each spray gun 100 may include multiple nozzles (not shown), each with a separately controlled valve. In this embodiment, one nozzle 122 applies repair fluid generally parallel to the pivot member 94 axis of rotation and the other nozzle applies repair fluid at an angle to the pivot member 94 axis of rotation. That is, the scoreline and the deformation 4 are located at different radial distances from the center of the can end 2. Thus, one nozzle 122 will be positioned to be in an application orientation for the deformation and the other will be positioned to apply repair fluid to the scoreline.

The spray assembly 50, described above, may be used with a repair machine 10 having alternate elements. For example, certain food cans 1, such as but not limited to sardine cans, are often generally rectangular. Can ends 2 for rectangular food cans (not shown) have a pull tab, and therefore the deformation (not shown), disposed at either a corner, or, generally at the middle of one of the shorter sides. When rectangular can ends (not shown) are placed on a conveyor belt with rectangular recesses (neither shown), the rectangular can end deformations are disposed either adjacent the leading edge or the trailing edge of the conveyor belt rectangular recess. The locator assembly 60 described above is also structured to determine the location of the rectangular can end deformations. In this embodiment, however, the spray heads may remain stationary. That is, a motion assembly 150 is not required in this embodiment. Instead, a number of spray heads (not shown) are disposed over the path the rectangular can end deformations travel. For example, if the rectangular can end deformations are disposed at the middle of the can end shorter side, the rectangular can end deformations must travel, generally, along a straight path. As such, a single spray head 90 is disposed generally over the middle of the path the recesses 38 travel. Further, in this embodiment, the locator assembly 60 passes a location signal to the control assembly (not shown). The control assembly 200 is structured to convert the location signal into a timing signal. The timing signal controls the time the spray gun 80 is actuated. That is, in this embodiment, the control assembly 200 is structured to time the actuation of the spray gun 80 so that the spray gun is actuated when the rectangular can end deformations are under the spray gun and the spray gun is in an application orientation relative to the rectangular can end deformation.

In another embodiment, not shown, the locator assembly 60 described above is structured to operate with a reorienting assembly. A reorienting assembly (not shown) is structured to reorient the can ends 2 while the can ends 2 are in motion on a can end conveyor assembly 30. For example, in an exemplary embodiment, the can end conveyor assembly 30 includes a reorienting assembly (not shown) structured to rotate the can ends 2 when the can ends 2 are in the conveyor belt recess 38. The reorienting assembly includes a rotation assembly operatively coupled to the magnet 40. In this embodiment, the locator assembly 60 determines the orientation of the can end deformation 4 as described above. The locator assembly 60 provides a location signal to the control assembly (not shown). The control assembly is in electronic communication with the rotation assembly and causes the rotation assembly to rotate the magnet 40, which in turn rotates the can end, so that the deformation 4 is in a selected location. In this embodiment, the spray heads 90 are stationary; thus, in this embodiment, there is no motion assembly 150.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A spray assembly for a repair machine, said repair machine structured to apply a repair fluid to a plurality of can ends, each said can end including a body and a first deformation, said can end body having an upper side and a perimeter, said first deformation disposed on said can end body upper side and adjacent said can end body perimeter, said repair machine including a can end conveyor assembly, said can end conveyor assembly structured to transport said can ends over a path, said can end conveyor assembly including a number of reference locations, said spray assembly comprising:

a locator assembly structured to determine the location of said first deformation relative to a can end conveyor assembly reference location and to provide a location signal;

a spray gun assembly including a number of spray guns and a motion assembly;

each said spray gun structured to apply a repair fluid to said can end;

said motion assembly structured to receive an orientation signal and, in response to said orientation signal, to position one said spray gun of said number of spray guns in an application orientation relative to said first deformation; and a control assembly, said control assembly structured to receive a location signal, to convert said location signal to orientation data, and to provide an orientation signal, said control assembly in electronic communication with said locator assembly and said motion assembly.

2. The spray assembly of claim 1 wherein:

said locator assembly includes a camera and a programmable logic circuit;

said camera structured to provide image data, said camera electronically coupled to said locator assembly programmable logic circuit; and said locator assembly programmable logic circuit structured to receive said image data, convert said image data to location data, and to provide said location signal.

3. The spray assembly of claim 2 wherein said first deformation includes a generally cylindrical rivet and a tab, and wherein:

said locator assembly is structured to determine the location of said rivet;

said location data includes data indicating the location of said rivet; and said motion assembly structured to position said spray gun assembly in an application orientation relative to said rivet.

4. The spray assembly of claim 3 wherein said rivet includes an indicia disposed on the rivet upper surface, and wherein said locator assembly is structured to determine the location of said rivet indicia.

5. The spray assembly of claim 4 wherein said locator assembly is disposed upstream of said spray gun assembly.

6. The spray assembly of claim 1 wherein:

said spray gun assembly includes a mounting member and a pivot member;

said pivot member rotatably coupled to said mounting member, said pivot member structured to rotate about an axis of rotation; and each said spray gun coupled to said pivot member, each said spray gun spaced from said pivot member axis of rotation.

7. The spray assembly of claim 6 wherein each said spray gun is structured to apply said repair fluid to a localized area on said can end.

8. The spray assembly of claim 7 wherein each spray gun assembly is structured to produce a stream of fluid.

9. The spray assembly of claim 7 wherein each spray gun assembly is structured to produce a stream of fluid that is one of either a stream that is generally parallel to said pivot member axis of rotation, or, that is generally at an angle relative to said pivot member axis of rotation.

10. The spray assembly of claim 9 wherein each spray gun assembly is structured to move over about a proportional arc.

11. The spray assembly of claim 10 wherein:

said pivot member includes a first end, a second end, a first mounting portion, a second mounting portion, and a counterweight;

said pivot member first end rotatably coupled to said mounting member;

said first mounting portion coupled to said pivot member second end;

said second mounting portion coupled to said pivot member second end, said second mounting portion disposed generally opposite said first mounting portion;

a first gun assembly coupled to said first mounting portion; and said counterweight coupled to said second mounting portion.

12. The spray assembly of claim 11 wherein:

said control assembly is structured to move said spray gun assembly according to a predetermined motion, said control assembly is structured to track the orientation of said pivot member, and, wherein said control assembly includes rotation limit data indicating a first rotation stop and a second rotation stop; and said predetermined motion is a limited oscillating motion between said first rotation stop and said second rotation stop.

13. The spray assembly of claim 10 wherein:

said pivot member includes a first end, a second end, a first mounting portion, a second mounting portion;

said pivot member first end rotatably coupled to said mounting member;

said first mounting portion coupled to said pivot member second end;

said second mounting portion coupled to said pivot member second end, said second mounting portion disposed generally opposite said first mounting portion;

a first spray gun assembly coupled to said first mounting portion; and a second spray gun assembly coupled to said second mounting portion.

* * * * *